US005651205A

United States Patent [19]

Ruger et al.

[11] Patent Number: 5,651,205

[45] Date of Patent: Jul. 29, 1997

[54] BOLT AND FIRING PIN LOCKING SYSTEM FOR FIREARM

[75] Inventors: William B. Ruger, Croydon, N.H.; Michael Smisko; James McGarry, both of Prescott, Ariz.

[73] Assignee: Sturm, Ruger & Company, Inc., Southport, Conn.

[21] Appl. No.: 626,768

[22] Filed: Mar. 29, 1996

[51] Int. Cl.[6] ..... F41A 17/24

[52] U.S. Cl. ..... 42/70.08; 89/153; 89/190

[58] Field of Search ..... 89/153, 152, 181, 89/189, 190; 42/70.08, 70.06, 70.04, 70.05, 70.01

[56] References Cited

U.S. PATENT DOCUMENTS 1,228,827 6/1917 Saalfield ..... 89/152

4,133,128 1/1979 Brush ..... 42/70.08

FOREIGN PATENT DOCUMENTS 575392 4/1933 Germany ..... 89/190

8242 of 1884 United Kingdom ..... 89/189

*Primary Examiner*—Stephen M. Johnson

*Attorney, Agent, or Firm*—Pennie & Edmonds LLP

[57] ABSTRACT

An autoloading firearm having a reciprocating bolt, a cocking lever and firing pin which bolt and firing pin are locked by a locking lever until the trigger is pulled or until the cocking lever of the bolt is manually pulled back. A linkage operably controlled by the trigger causes the locking lever to unlock the bolt and firing pin when the trigger is pulled.

10 Claims, 5 Drawing Sheets

BOLT AND FIRING PIN LOCKING SYSTEM FOR FIREARM

BACKGROUND OF THE INVENTION

Autoloading firearms in which the bolt is held only by spring pressure and the inertia of the mass of the bolt against the barrel to prevent premature opening when firing (principally known as "blow back" firearms) are known. External forces applied to such firearms, particularly upon the butt plate when the muzzle is elevated, can cause the bolt to move rearward prior to firing to unintentionally unload the firearm. This is particularly detrimental in the case of police-type service firearms.

It is also desirable to lock the firing pin against movement toward a cartridge in the firing chamber of the firearm unless the trigger is pulled.

SUMMARY OF THE INVENTION

Broadly, the present invention comprises an automatic locking latch arrangement for securely locking the bolt and/or the firing pin of an autoloading firearm in its closed position against the barrel until the trigger is pulled or the cocking lever of the bolt is manually pulled back.

It is a feature that the locking arrangement is inactivated due to trigger pull during the cycle of bolt travel during normal firing, including cartridge ejection and reloading.

DESCRIPTION OF THE PREFERRED EMBODIMENT

Figure 1:
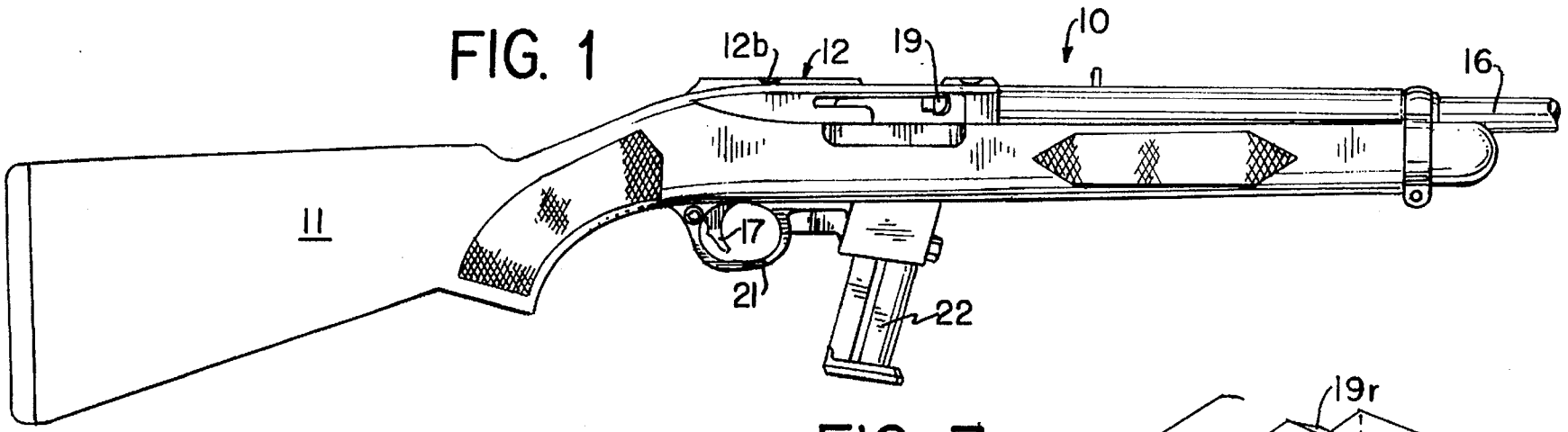
FIG. 1 is a right side elevational view of the firearm of the present invention (with a portion of the barrel not shown)

In FIGS. 1–4, carbine 10 includes stock 11, receiver 12, receiver blister **12*b*, receiver blister opening 12c, receiver mount block 13 with forward blister 13*b*, bolt 14, barrel 16, cartridge C, trigger 17, trigger body 17*e* and trigger return spring 17*s*. Also shown are hammer 15, hammer strut 15*a*, hammer strut mount 15*b*, hammer spring 15*c*, bolt cocking handle 19, sear 20, trigger guard 21, cartridge extractor 18 and magazine 22**.

Figure 7:
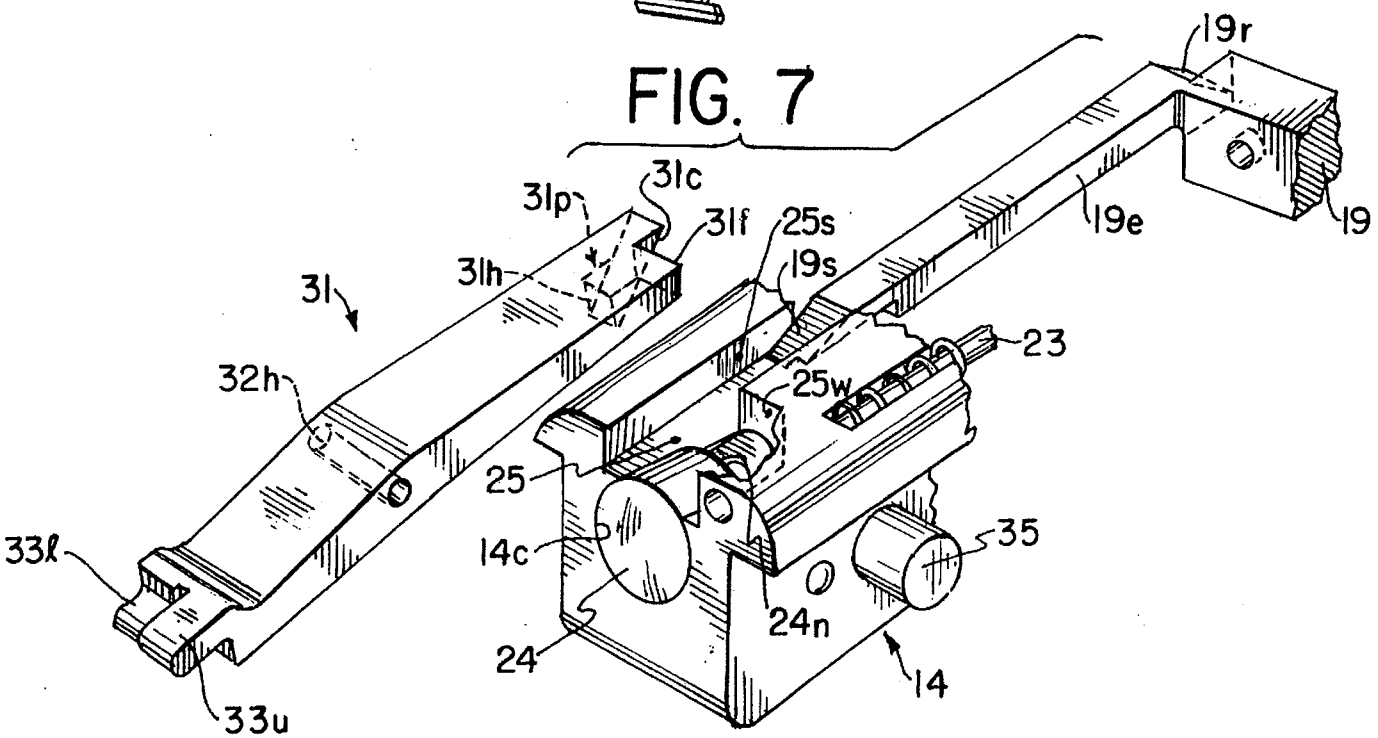
FIG. 7 is a perspective view of the bolt, the firing pin, the bolt handle and the lock lever.
Figure 2:
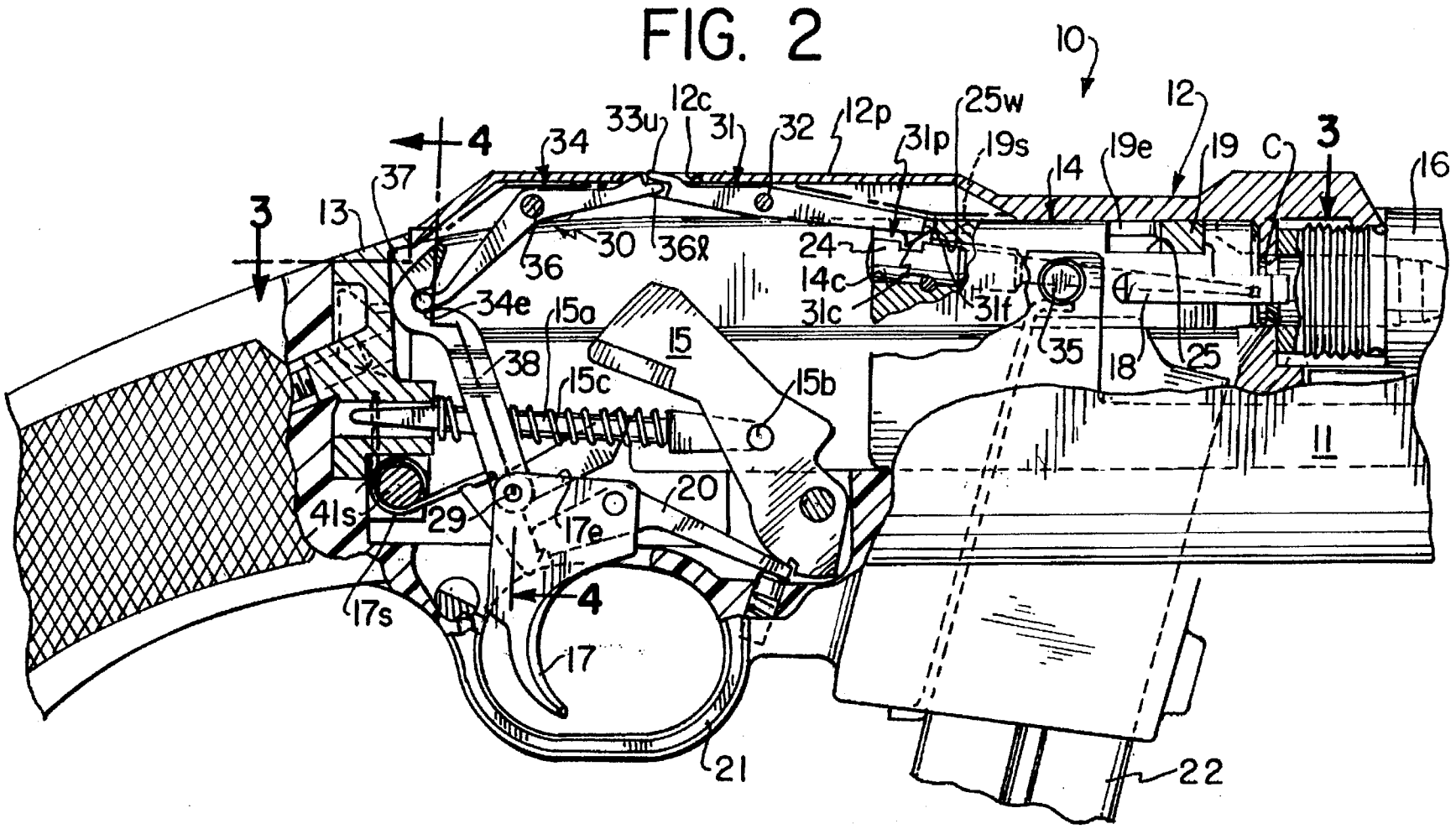
FIG. 2 is a partial sectional elevational view of the locking arrangement in lock position with the hammer cocked and the trigger at rest.
Figure 3:
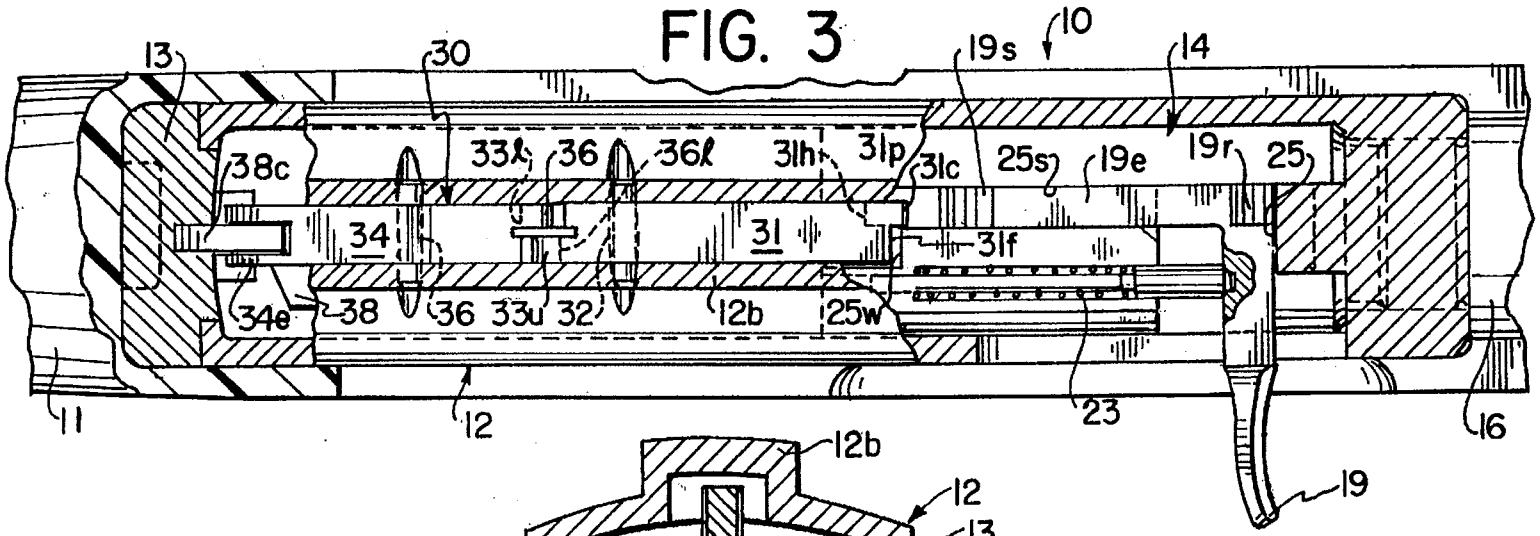
FIG. 3 is a sectional view taken along line 3—3 of FIG. 2.
Figure 4:
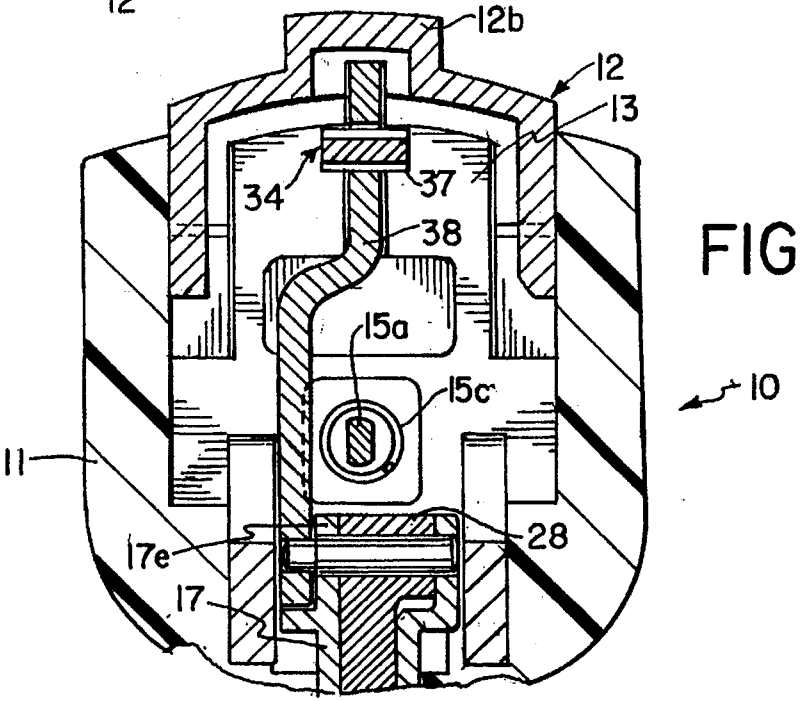
FIG. 4 is a sectional view taken along line 4—4 of FIG. 2.

Turning in particular to FIGS. 2, 3, and 7, bolt 14 has internal bolt cavity **14*c* for housing reciprocating firing pin 24. Bolt 14 has upper bolt notch 25 with slot 25*s* for receiving cocking handle extension 19*e* and notch 25 also includes a vertical stop wall 25*w*. Cocking handle 19*e* has rear sloping cam surface 19*s* and forward angled surface 19*r*. Firing pin 24 has recess notch 24*n*. To prevent bolt 14 from moving rearwardly should carbine 10 be dropped or jolted and to prevent firing pin 24 from moving forward unless trigger 17 is pulled, bolt and pin locking arrangement 30 secures bolt 14 and pin 24 until trigger 17 is pulled or cocking handle 19 is pulled back. Cylindrical post 35 on bolt 14 is connected to a recoil spring and associated parts (not shown) which spring urges bolt 14** against cartridge C.

As shown in FIG. 2, locking arrangement 30 includes (1) pin-bolt first lock lever 31 pivotally mounted on pivot pin 32 positioned in lever hole **32*h*; (2) second rearward lever 34 also pivotally mounted on a pin 36 also in blister 12*b*; (3) a substantially vertically positioned hooked actuator member 38 pivotal about pin 29 on trigger body 17*e*. Actuator member 38 has upper socket opening 37 to receive lever head 34*e* of lever 34. First lock lever 31 carries at its forward end a vertical bolt stop face 31*f*, a sloping cam wall 31*c* and a hook portion 31*p* with vertical hook surface 31*h* (see also FIG. 7). Also shown is disconnect member 28 pivoted on pin 29 and urged counterclockwise by trigger spring 41 (FIG. 5**).

FIG. 2 illustrates locking arrangement 30 in its lock position, with lock lever stop face **31*f* abutting (or slightly spaced from) bolt stop wall 25*w*. In this position, bolt 14 can be moved rearward only a small distance until stop wall 25*w* abuts bolt stop surface 31*f*. Any further movement of bolt 14 is thereafter prevented by locking arrangement 30. At the same time, lever 31 engages firing pin 24 as lever hook piece 31*p* engages pin notch surface 24*n*. Such engagement prevents firing pin 24** from moving forward to a firing position where it might strike a cartridge in the firing chamber.

First lock lever 31 has rearward end upper and lower projections **33*u*, 33*l* which cooperate with complementary upper and lower projections 36*u*, 36*l* of second lever 34 to cause the levers 31, 34 to move together. Projections 33*u*, 33*l*, 36*u*, 36*l* are accommodated in receiver opening 12*c* which opening may be covered by a scope mount. Second lever 34 has rearward end 34*e* which rides in opening 37 of linkage member 38**.

Figure 5:
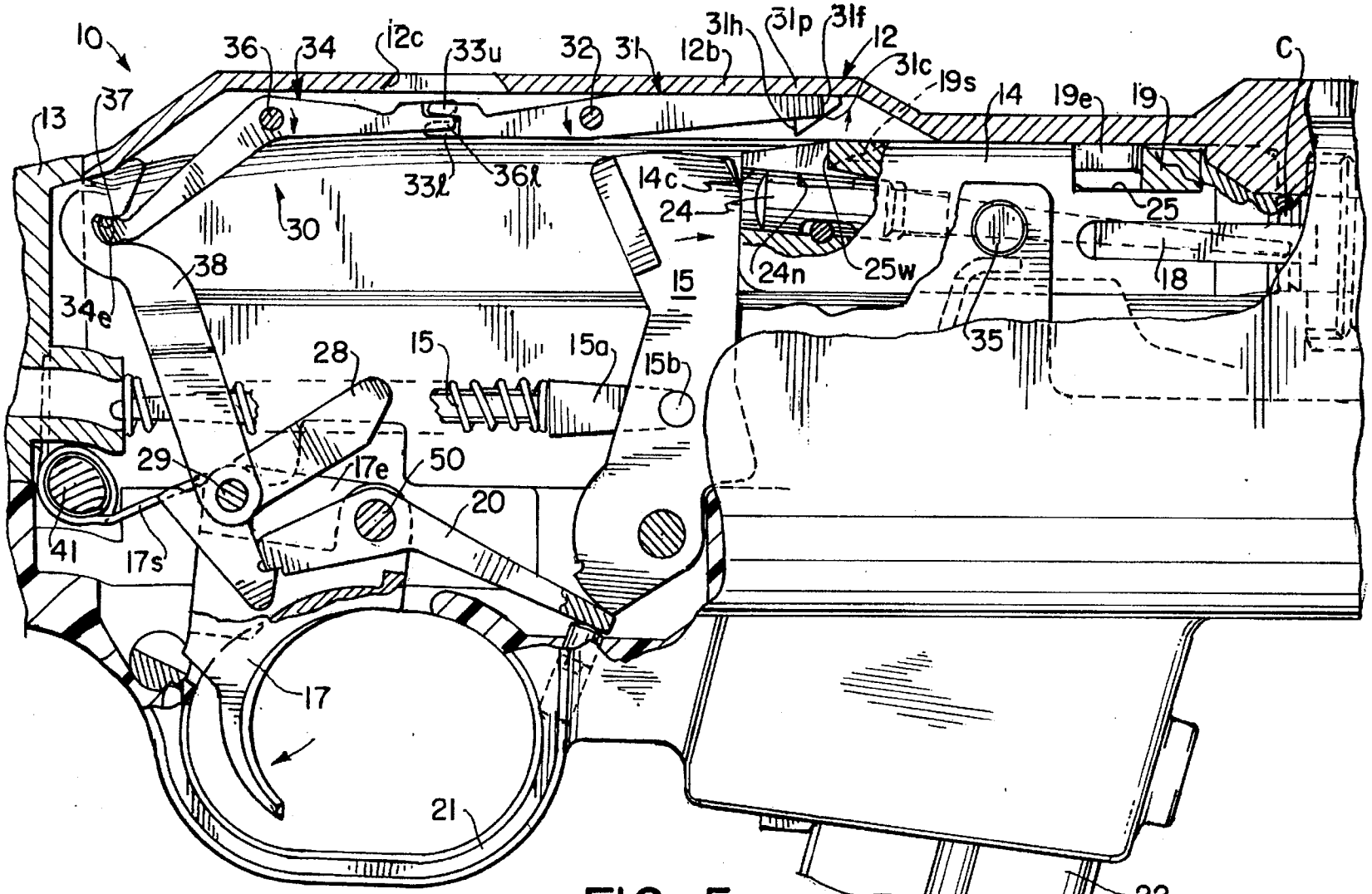
FIG. 5 is an enlarged view similar to FIG. 2 with the trigger pulled and the hammer in the fire position.

Turning now to FIG. 5, the operation of lock arrangement to release bolt 14 and pin 24 is shown. As trigger 17 is pulled, trigger body **17*e* is rotated clockwise about pin 50 and raised causing actuator 38 to also rise with its socket opening 37 in turn carrying lever head 34*h* upward. Actuator member 38 thereby causes second lever 34 to rotate about pin 36 which causes first lever 31 to rotate in the opposite direction to raise the forward end of first lever 31 releasing bolt 14 and pin 24. During such operation, trigger movement further causes disconnect member 28 to rotate to turn sear 20 releasing hammer 15. Hammer 15 is urged by spring 15*c* against inertial firing pin 24 which moves forward to strike the cartridge to fire carbine 10. Immediately after firing, bolt 14 commences moving rearwardly from the gas pressure of firing, which movement is not interfered with since trigger 17** is still in its pulled position.

Figure 6:
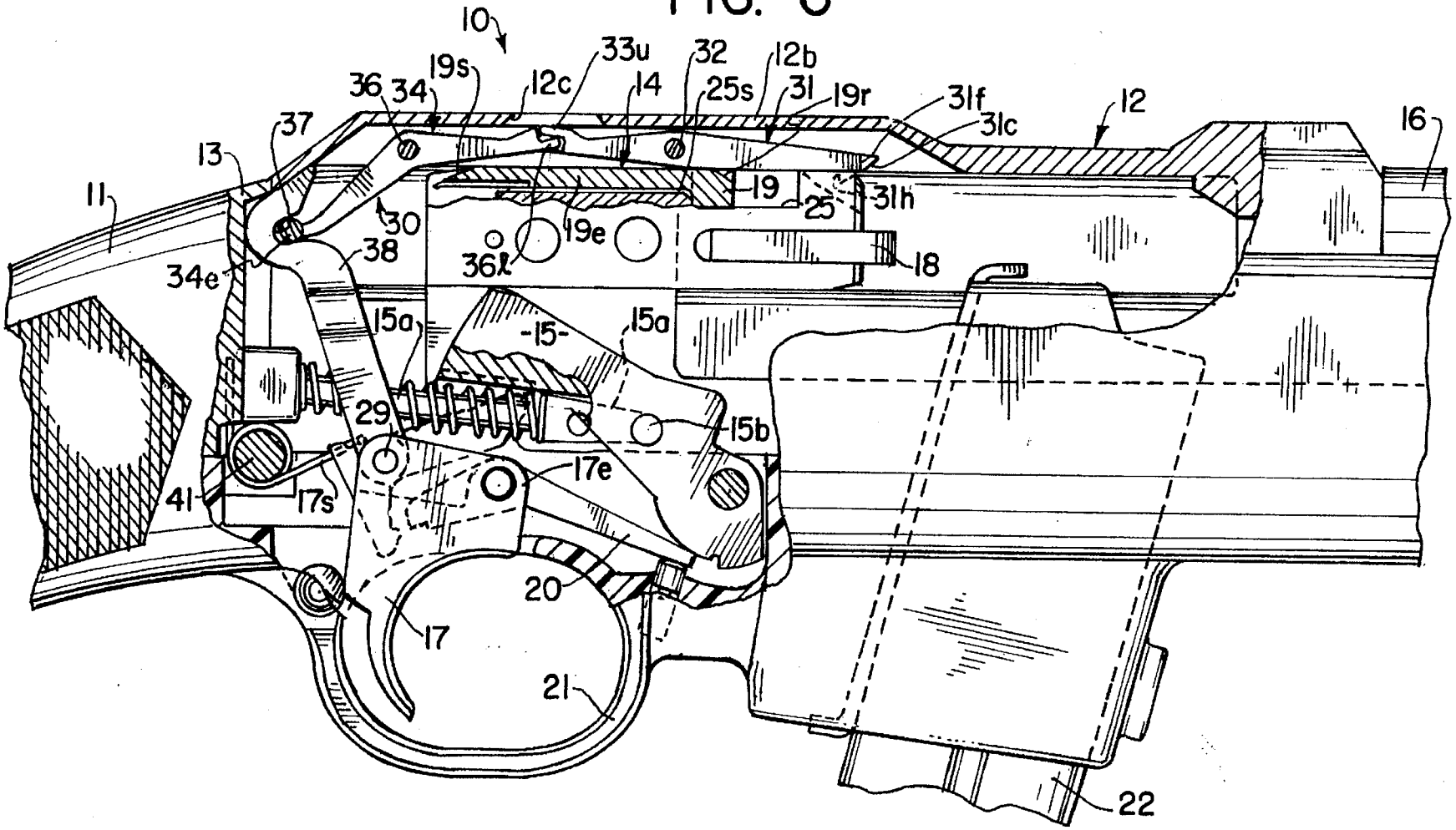
FIG. 6 is an enlarged view similar to FIG. 2 with the bolt manually withdrawn using the cocking handle.

Finally, FIG. 6 shows bolt 14 fully retracted and ready to commence the reloading portion of the carbine's cycle. Lever 31 lies on bolt upper surface **14*u* (see also FIG. 7**).

In operation of carbine 10, bolt 14 is capable of automatic retraction when trigger 17 is pulled and carbine fires, or when by manual retraction cocking handle 19 is pulled back. Either actions will rotate lock lever 31 to allow bolt 14 to move rearwardly through its full travel. Pulling of cocking handle 19 is resisted in its rearward movement by handle spring 23 shown in FIG. 3. Since cocking handle 19 has a small mass, it does not move a significant distance rearwardly against spring 23 if butt plate of carbine 10 is struck. Bolt 14 is urged against cartridge C by a large recoil spring (not shown) linked to bolt 14 through cylindrical post 35.

We claim:

1. An autoloading firearm including a barrel that contains a firing chamber containing a cartridge, a receiver, a bolt for reciprocating in the receiver from a position adjacent to the cartridge to a rearward position, a spring urging an unlocked said bolt against the cartridge when fired, a bolt cocking handle, a firing pin, a sear and a trigger and further comprising a) a bolt notch means;

b) a lock arrangement means for locking the bolt in its forward position adjacent to the cartridge which lock arrangement means in turn comprises i) bolt engagement means for engaging the bolt notch means; and ii) actuating means operated by the trigger for actuating the bolt engagement means to disengage the bolt to permit firing of the firearm; and c) a hammer released by action of the trigger and sear after the actuating means has been operated by the trigger to disengage the bolt.

2. The firearm of claim 1 in which the firing pin has firing pin notch means and in which the lock arrangement means engages such firing pin notch means to prevent forward movement of the firing pin toward the cartridge in the firing chamber.

3. The firearm of claim 1 in which the bolt engagement means of the lock arrangement means includes a first lever means and in which the actuating means comprises a second lever means and an actuator member and in which the actuator member when moved by the trigger causes the second lever means to pivot and engage the first lever means which in turn pivots to unlock the bolt.

4. The firearm of claim 3 having in addition a disconnect member mounted on the trigger which disconnect member causes the sear to move to release the hammer when the trigger is pulled.

5. The firearm of claim 3 in which the bolt includes said cocking handle which handle has a deflection surface to deflect and deactivate the first lever when the bolt handle moves rearwardly.

6. The firearm of claim 3 in which the first lever means and second lever means engage through upper and lower projections.

7. The firearm of claim 1 in which the bolt is locked against substantial inadvertent rearward movement by the lock arrangement means until the lock arrangement means is moved to an unlocked position by said trigger pull or said cocking handle pull.

8. The firearm of claim 1 in which the mass of said cocking handle is not sufficient to cause the handle to move rearward to unlock the locking arrangement means when the firearm is dropped or jolted.

9. An autoloading firearm including a barrel that contains a firing chamber capable of containing a cartridge, a receiver, a bolt for reciprocating in the receiver from a position adjacent to the cartridge to a rearward position, a bolt cocking handle, a firing pin and a trigger and further comprising a) a bolt notch means;

b) a lock arrangement means for locking the bolt in its forward position adjacent to the cartridge which lock arrangement means in turn comprises i) bolt engagement means for engaging the bolt notch means;

ii) actuating means operated by the trigger for actuating the bolt engagement means to disengage the bolt to permit firing of the firearm; and c) notch means in the firing pin engageable by the lock arrangement means to prevent forward movement of the firing pin toward the cartridge in the firing chamber until the trigger is pulled.

10. An autoloading firearm including a barrel that contains a firing chamber capable of containing a cartridge, a receiver, a bolt for reciprocating in the receiver from a position adjacent to the cartridge to a rearward position, a bolt cocking handle, a firing pin and a trigger and further comprising a) a bolt notch means;

b) a lock arrangement means for locking the bolt in its forward position adjacent to the cartridge which lock arrangement means in turn comprises i) bolt engagement means including a bolt engageable lever for engaging the bolt notch means;

ii) actuating means operated by the trigger for actuating the bolt engagement means to disengage the bolt to permit firing of the firearm; and c) a deflection surface on the bolt cocking handle to deflect and deactivate the bolt engageable lever when the bolt cocking handle moves rearwardly.

* * * * *